US006146158A

United States Patent [19]

Peratoner et al.

[11] Patent Number: 6,146,158

[45] Date of Patent: Nov. 14, 2000

[54] SELF-ADJUSTING SHELF MOUNTED INTERCONNECT FOR A DIGITAL DISPLAY

[75] Inventors: Sergio Peratoner, Paramount; James Hayes, Torrance, both of Calif.

[73] Assignee: Tagnology, Inc., Irwindale, Calif.

[21] Appl. No.: 09/151,808

[22] Filed: Sep. 14, 1998

[51] Int. Cl.[7] ..... H01R 25/00

[52] U.S. Cl. ..... 439/110; 439/121; 340/825.54

[58] Field of Search ..... 439/110, 116, 439/117, 121, 122; 340/825.54, 147 A, 825.35, 825.03

[56] References Cited

U.S. PATENT DOCUMENTS

| | | | |
|---|---|---|---|
| 3,757,063 | 9/1973 | Hart et al. | 439/110 |
| 4,002,886 | 1/1977 | Sundelin | 340/147 A |
| 4,097,136 | 6/1978 | Astarloa | 439/110 |
| 4,500,880 | 2/1985 | Gomersall et al. | 340/825.35 |
| 5,245,534 | 9/1993 | Waterhouse et al. | 340/825.35 |
| 5,348,485 | 9/1994 | Briechle et al. | 439/110 |
| 5,453,737 | 9/1995 | Opoczynski | 340/825.03 |

*Primary Examiner*—Michael L. Gellner
*Assistant Examiner*—Antoine Ngandjui
*Attorney, Agent, or Firm*—Morland C. Fischer

[57] ABSTRACT

A self-adjusting shelf mounted interconnect is disclosed including a bus connector having a series of electrical contacts to engage respective conductive strips of a first electrical bus that runs along a shelf carrying gondola. The self-adjusting interconnect is mounted below a shelf so that when the shelf is removably attached to the gondola, the contacts of the bus connector are automatically mated to the conductive strips of the electrical bus, whereby information transmitted from a remote computer to the first electrical bus can be transmitted to a second electrical bus that runs along the front of the shelf and to a particular one of a plurality of electronic price tag modules that are coupled to the second electrical bus to receive and display the information transmitted from the remote computer. The bus connector is adapted to rotate in response to a pushing force applied thereto when the shelf is connected to the gondola so as to maintain the electrical contacts of the bus connector in constant facing alignment with the conductive strips of the first electrical bus.

16 Claims, 6 Drawing Sheets

SELF-ADJUSTING SHELF MOUNTED INTERCONNECT FOR A DIGITAL DISPLAY

BACKGROUND OF THE INVENTION

1. Field of the Invention

This invention relates to a self-adjusting mechanical interconnect to enable information signals supplied to a first data bus from a remote computer to be transmitted via a data path to a second data bus to which one or more electronic price tags are connected to display the information signals. The self-adjusting interconnect has particular application in an electronic price tag system and is affixed to a shelf of a shelf-carrying gondola along which the electronic price tags are located so that information concerning goods stored on the shelf can be displayed to consumers.

2. Background Art

In U.S. patent application Ser. No. 08-565,733 filed Nov. 30, 1997, an electronic price tag system is disclosed having particular application in a retail store environment for use at a gondola which carries one or more detachable shelves having goods stored thereon for sale to the public. A remote computer transmits address, price, and other information to a master controller that is located at the gondola. The master controller decodes the information from the remote computer and, in turn, transmits the information to respective slave controllers located at each of the shelves of the gondola. Each slave controller is responsible for selectively accessing and energizing one of a plurality of electronic price tag modules located along the front of the shelf so as to cause information to be displayed concerning the goods that are stored on the shelf.

In many cases, the gondola that carries the detachable shelves on which the respective slave controllers will be located includes a pair of vertical mounting rails and a flat back plane extending between the rails. The data bus of U.S. patent application Ser. No. 08-565,733 which places the master controller of the gondola in communication with the slave controllers of the shelves runs vertically along the back plane of the gondola so that when a shelf is attached to the mounting rails of the gondola, the slave controller of such shelf will be automatically aligned with and electrically connected to the vertical data bus along the back plane.

However, and depending upon the construction of the gondola, the distance between the shelf and the back plane of the gondola will typically vary from store-to-store. Therefore, there can be no certainty that a slave controller or its equivalent will be reliably connected to the vertical data bus when the shelf to which the slave controller is connected is attached to the mounting rails. As a consequence of the foregoing, the data path between the remote computer and the price tag modules of a conventional pricing system may be undesirably interrupted or broken. In addition, the slave controller of the conventional system may be damaged during an attempt to physically maneuver the shelf so as to place the slave controller thereof in electrical contact with the vertical data bus that runs along the back plane of the gondola. What is even more, signal buses are currently being interconnected manually rather than automatically which is tedious, time consuming, and may also lead to damage.

SUMMARY OF THE INVENTION

In general terms, a self-adjusting shelf mounted interconnect is disclosed that overcomes the aforementioned problem and enables the slave controller of the electronic price tag system to automatically compensate for different distances between the shelf to which the slave controller is attached and the back plane of a gondola to which the shelf is removably attached and along which the vertical data bus runs. The shelf mounted interconnect (i.e. slave controller) includes a housing that is adhesively mounted underneath the shelf. A bus connector having a series of spring-loaded contacts is pivotally connected to the housing by means of idler and follower arms extending therebetween. When the shelf is removably attached to the gondola, the contacts of the bus connector are automatically mated to respective conductive strips of the vertical data bus on the back plane of the gondola without any additional manual intervention.

Enclosed within the housing of the shelf mounted interconnect is a printed circuit board. One edge of the circuit board is electrically connected to the contacts of the bus connector via a first ribbon cable, and another edge of the circuit board is connected via a second ribbon cable to a data bus that runs horizontally along the front of the shelf and to a plurality of electronic price tag modules that are coupled to the horizontal data bus. Accordingly, when the bus connector of the shelf mounted interconnect is electrically connected to the vertical data bus along the gondola, a data path is established from a remote computer to the electronic price tag modules by way of the vertical data bus, the contacts of the bus connector, the printed circuit board, the first and second ribbon cables, and the horizontal data bus along the shelf so that the price tag modules can display data transmitted by the computer to indicate price and other information concerning goods that are stored on the shelf. The printed circuit board controls the routing of the data from the remote computer to a particular one of the plurality of price tag modules along the front of the shelf.

By virtue of the fact that the bus connector is pivotally connected to the housings the bus connector is adapted to rotate relative to the housing in response to a pushing force applied to the bus connector when the shelf to which the interconnect is attached is connected to the gondola and the bus connector is mated to the vertical data bus at the back plane of the gondola. A rotation of the bus connector assures that the contacts thereof will be maintained in constant facing alignment with the conductive strips of the vertical data bus to provide for a reliable electrical connection therebetween.

DETAILED DESCRIPTION

Figure 1:
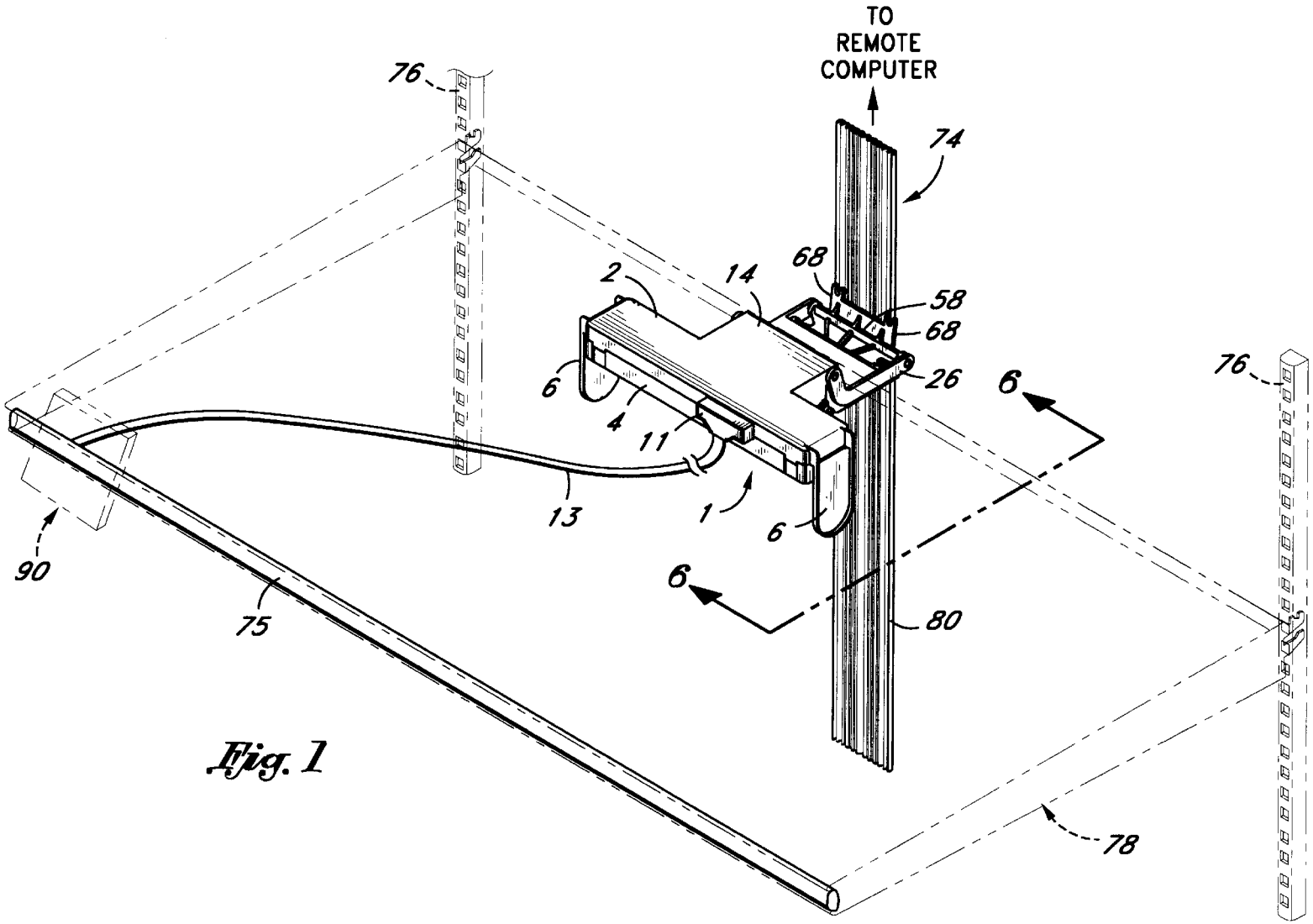
FIG. 1 shows the self-adjusting shelf mounted interconnect of the present invention mounted below a shelf of a gondola and electrically connected between vertical and horizontal data buses.
Figure 2:
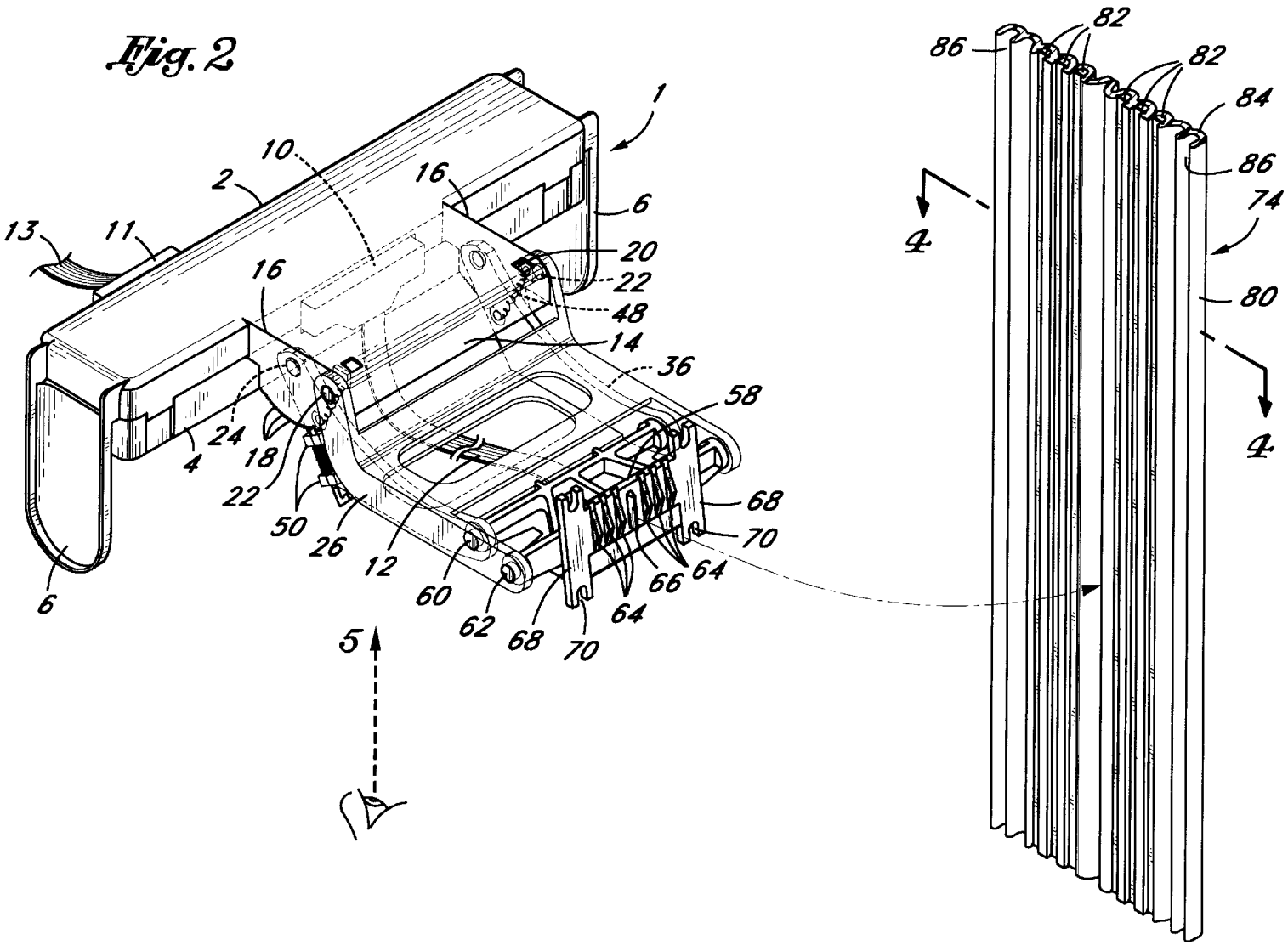
FIG. 2 shows the self-adjusting shelf mounted interconnect in the assembled configuration to be detachably coupled to the vertical data bus of FIG. 1.
Figure 3:
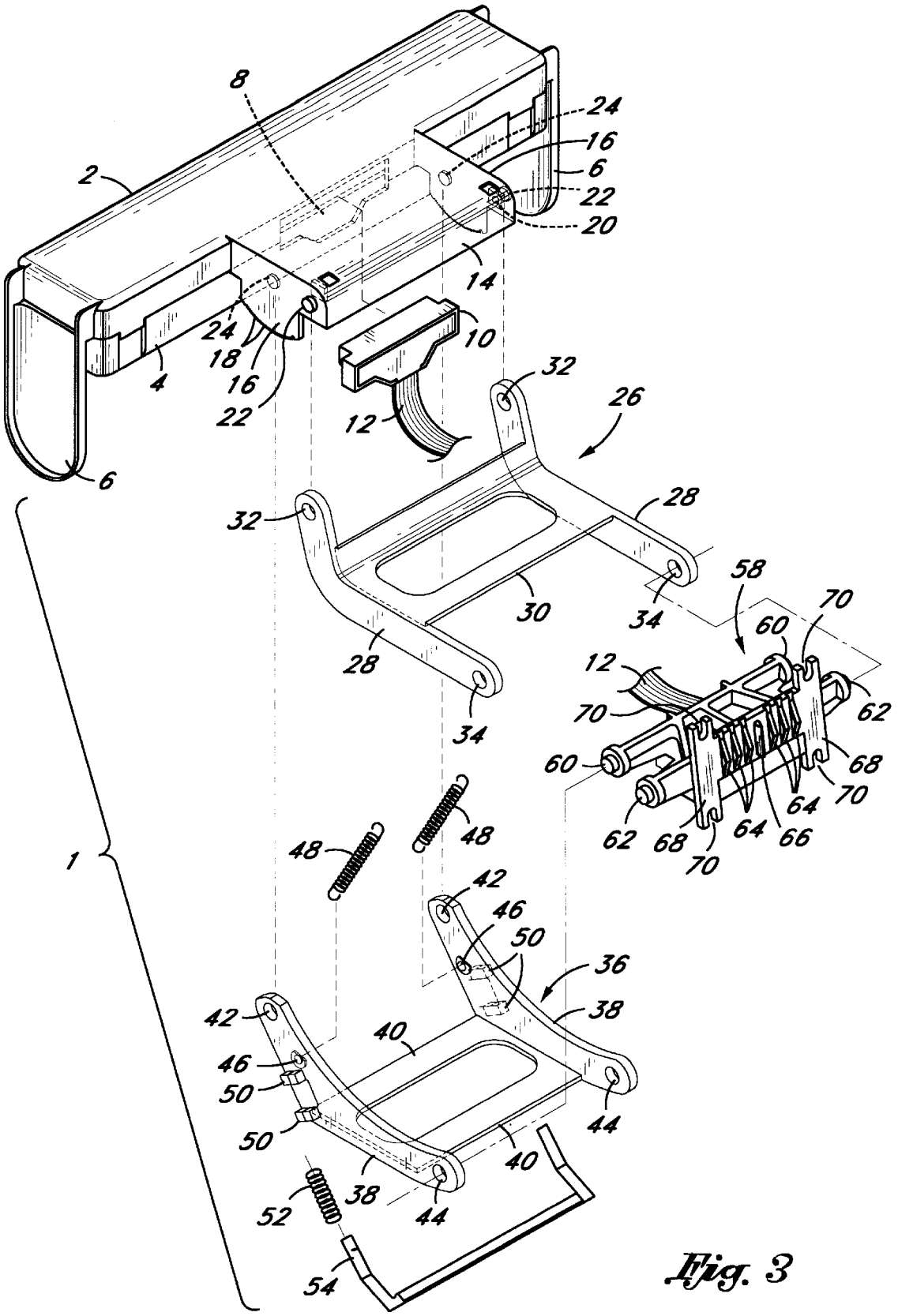
FIG. 3 is an exploded view of the self-adjusting shelf mounted interconnect.
Figure 4:
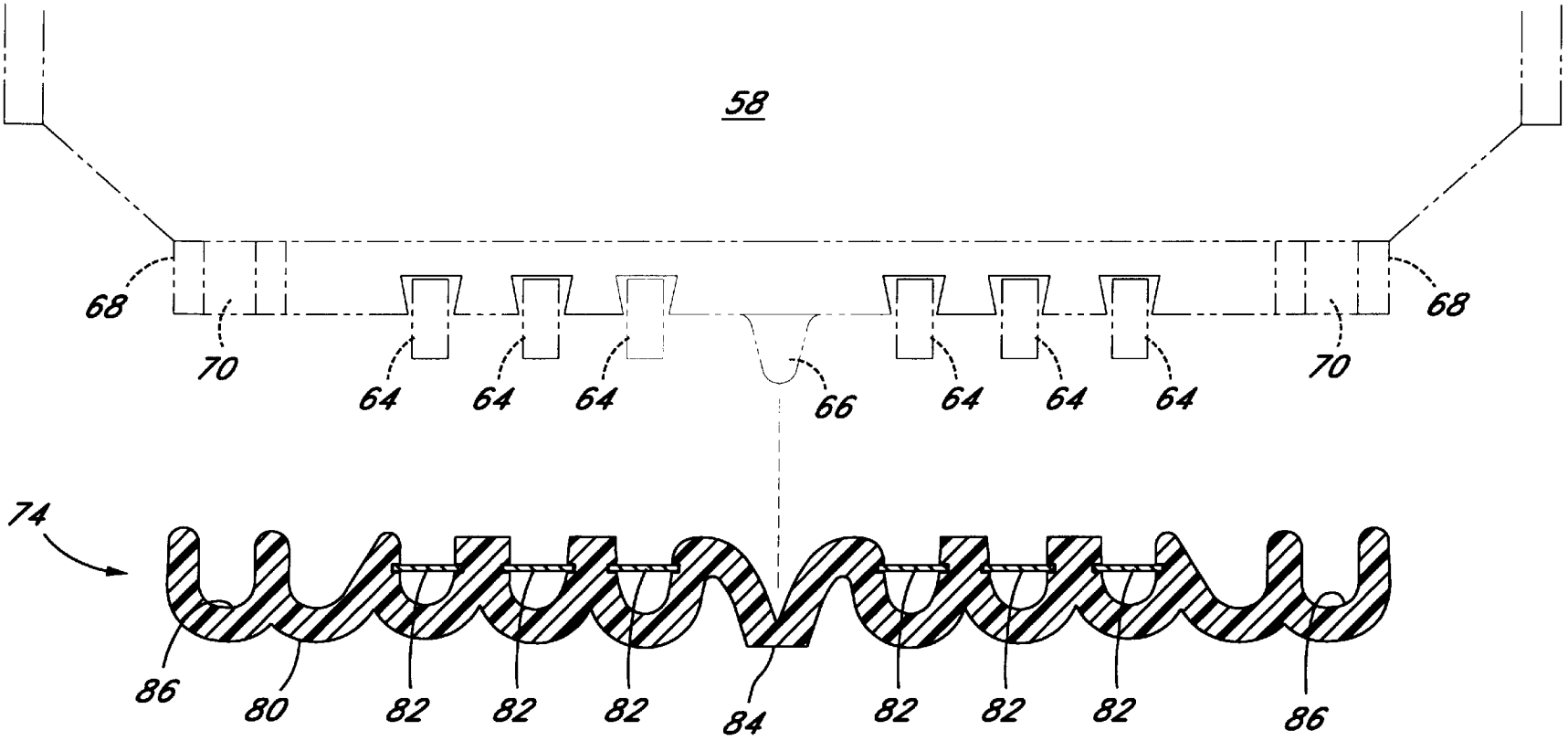
FIG. 4 illustrates the contacts of a bus connector of the self-adjusting shelf mounted interconnect moving into electrical contact with respective conductive strips of the vertical data bus.

The self-adjusting shelf mounted interconnect 1 for a digital display which forms the present invention is now described while referring initially to FIGS. 1–3 of the drawings. The shelf mounted interconnect 1 includes an upper housing 2 and a lower housing 4 that are snapped together one above the other. A pair of parallel aligned load bearing ears 6 depend downwardly from opposite ends of the upper housing 2. The ears are sized to provide rigid support for and prevent possible damage to the shelf mounted interconnect 1 in the event that the shelf (designated 78 in FIG. 1) underneath which the interconnect is mounted is removed from its shelf carrying gondola and laid on the ground.

Figure 5:
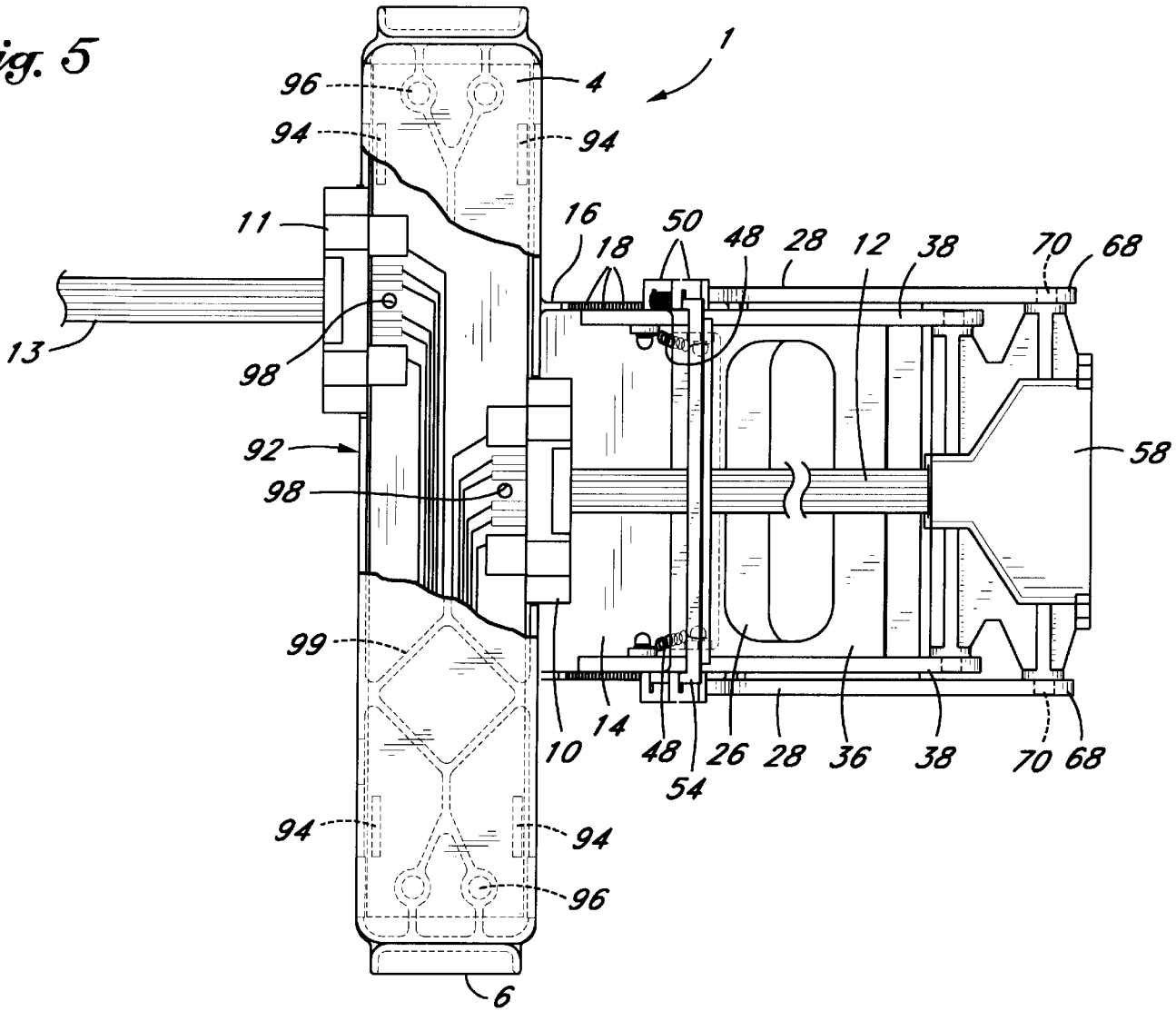
FIG. 5 shows the data path established between the vertical and horizontal data buses by way of the self-adjusting shelf mounted interconnect.

As will soon be explained, the upper and lower housings 2 and 4 define a hollow enclosure for surrounding a printed circuit board (designated 92 FIG. 5). A first input port 8 (best shown in FIG. 3) is formed through the interface of the upper and lower housings 2 and 4 at the rear of shelf mounted interconnect 1. The input port 8 is sized and shaped to receive therewith in a circuit board connector 10 that is adapted to make electrical contact with one edge of the circuit board 92 surrounded by upper and lower housings 2 and 4. A conventional ribbon cable 12 connects the circuit board 92 from (circuit board connector 10 to a plurality of bus contacts 64 of a bus connector 58, the details of which will soon be disclosed.

Depending rearwardly from the upper housing 2 of shelf mounted interconnect 1 is a hood or shield 14 which extends over top of and covers the first input port 8 and the circuit board connector 10 located therein. Projecting downwardly from the ends of hood 14 is a pair of opposing arcuate shaped side walls 16. As an important feature of the self-adjusting nature of the shelf mounted interconnect 1, each of the arcuate side walls is ratcheted so as to include a series of pointed teeth 18 running therealong. An upper spring terminal 20 is formed at the underside of hood 14 above the teeth 18 of each side wall 16. A pair of outwardly extending pivot pins 22 projects away from one another, and a pair of inwardly extending pivot pins 24 projects towards one another from respective side walls 16 of hood 14. The functions of the pairs of pivot pins 22 and 24 for pivotally connecting idler and follower arms 26 and 36 of interconnect 1 to the hood 14 will be described hereinafter.

The aforementioned idler arm 26 includes a pair of identical side walls 28, each of which having a generally "L" shape. A pair of parallel aligned cross braces 30 extend laterally between side walls 28 of idler arm 26 to space the side walls from one another and provide structural rigidity. The area between cross braces 30 is preferably removed to minimize the weight of the idler arm 26. First and second pairs of holes 32 and 34 are formed through opposite ends of the side walls 28 of idler arm 26. In the assembled configuration of the shelf mounted interconnect 1 (as shown in FIG. 2), the idler arm 26 is pivotally connected to the side walls 16 of the hood 14 of upper housing 2 by snapping the pair of outwardly extending pivot pins 22 into the corresponding first pair of holes 32. The function of the second pair of holes 34 by which a bus connector 58 is pivotally connected to the idler arm 26 will also be described hereinafter.

Like the idler arm 26, the follower arm 36 includes a pair of side walls 38, each of which having a generally "L" shape. A pair of parallel aligned cross braces 40 extend laterally between side walls 38 of follower arm 36 to space the side walls 38 from one another and provide structural rigidity. The area between cross braces 40 is removed to minimize the weight of the follower arm 36. First and second pairs of holes 42 and 44 are formed through opposite ends of the side walls 38 of follower arm 36. In the assembled configuration of the shelf mounted interconnect 1 shown in FIG. 2, the follower arm 36, like the idler arm 26, is pivotally connected to the side wall 16 of hood 14. However, in this case, the pair of inwardly-extending pivot pins 24 from side walls 16 are snapped into the first pair of holes 42 in follower arm 36. The function of the second pair of holes 44 by which the bus connector 58 is pivotally connected to the follower arm 36 will soon be described.

Projecting inwardly from each of the side walls 38 of follower arm 36 below the first pair of holes 42 thereof is a pair of lower spring terminals 46. A pair of coil springs 48 is attached between the upper housing 2 and the follower arm 36. More particularly, in the assembled configuration of the shelf mounted interconnect 1 shown in FIG. 2, first ends of the pair of coil springs 48 are attached to respective upper spring terminals 20 which project inwardly from the side walls 16 of hood 14, while the opposite ends of the coil springs 48 are attached to respective lower spring terminals 46 which project inwardly from the side walls 38 of follower arm 36. The purpose of coil springs 48 is to bias the shelf mounted interconnect 1 to automatically return from the retracted interconnect position shown in FIG. 7 to the extended interconnect position shown in FIG. 6.

A pawl guide having opposing guide channels 50 is located on the outside of each side wall 38 of follower arm 36. A short compression spring 52 is sized to be located between the guide channels 50 of each pawl guide. A pair of pawls 54 are carried at opposite ends of a push bar 53. When each pawl 54 is pushed longitudinally by means of bar 53 through the channels 50 of a pawl guide and the compression spring 52 is located therebetween, the spring is compressed and the tips of the pawls 54 are urged into receipt between pairs of adjacent teeth 18 that run along the side walls 16 of the hood 14 of upper housing 2. This feature is important for preventing inward movement of and retaining the self-adjusting interconnect 1 at any of a variety of different positions between the extended and retracted interconnect positions shown in FIGS. 6 and 7 depending upon the distance between the shelf (designated 78 FIG. 1 ) which carries the interconnect 1 and a data bus 74 to which the bus connector 58 of the interconnect 1 is to be detachably coupled.

As earlier disclosed, a bus connector 58 is pivotally connected to each of the idler arm 26 and follower arm 36 or interconnect 1. To this end, the bus connector 58 has first and second pairs of parallel aligned pivot legs 60 and 62 that extend outwardly and in opposite directions. In the assembled configuration of the shelf mounted interconnect 1 shown in FIG. 2, the first pair of pivot legs 60 of bus connector 58 is snapped into respective ones of the second pair of holes 44 in the side walls 38 of follower arm 36, and the second pair of pivot legs 62 of the bus connector is snapped into respective ones of the second pair of holes 34 in the side walls 28 of the idler arm 26. Accordingly, the idler arm and follower arm 26 and 36 are pivotally connected between the hood 14 of upper housing 2 and the bus connector 58, whereby the bus connector 58 is adapted to be displaced through a short arc between the extended and retracted interconnect positions of FIGS. 6 and 7 in response to a pushing force against the bus connector 58 that is generated during the attachment of the shelf 78 of FIG. 1 to a gondola and the corresponding coupling of the bus connector 58 to a data bus 74 that runs vertically along the gondola.

The assembly of the self-adjusting shelf mounted interconnect 1 is completed by locating another circuit board connector 11 (shown in FIGS. 1 and 2) in a second input port (not shown) through the interface of the upper and lower housings 2 and 4 at the front of interconnect 1 opposite the first input port 8. Circuit board connector 11 is adapted to make electrical contact with another edge of the circuit board 92 (best shown in FIG. 5) that is enclosed by upper and lower housings 2 and 4. A conventional ribbon cable 13 connects the circuit board 92 from circuit board connector 11 to a horizontal data bus 75 that runs along the front edge of the shelf 78 (best shown in FIG. 1).

To facilitate the electrical connection to the vertical data bus 74, the bus connector 58 of interconnect 1 is provided with a row of spaced, parallel aligned, spring-loaded bus contacts 64. An alignment tab 66 is located on bus connector 58 at the middle of the row of bus contacts 64 to aid in properly locating the bus connector on the data bus 74. A pair of mounting tabs 68 are positioned at the opposite sides of the bus connector 58. Each mounting tab 68 has optional screw holes 70 formed therein to enable the bus connector 58 to be fixedly attached to the data bus 74 by means of screws, or the like, with the spring-loaded bus contacts 64 being held in electrical connection with respective conductors of the vertical data bus 74. The previously-described ribbon cable 12 is electrically connected between the circuit board 92 at the circuit board connector 10 and the bus contacts 64 of bus connector 58, whereby to communicate with the conductors of the vertical data bus 74 at the gondola 76.

The mechanical and electrical connections of the self-adjusting shelf mounted interconnect 1 of this invention are now described in detail while referring concurrently to FIGS. 1–5 of the drawings. The vertical data bus 74 is carried by a conventional gondola of the type commonly found in retail stores to which a number of shelves are removably attached for holding and displaying different goods to be sold to consumers. The gondola includes a pair of steel mounting rails 76 (shown in FIG. 1) that are approximately six feet long and have a series of slots so that one or more shelves can be selectively positioned at various elevations therealong. The mounting rails 76 are secured to opposite side of a flat (e.g. particle board) back plane 100 (shown in FIGS. 5 and 6).

Figure 6:
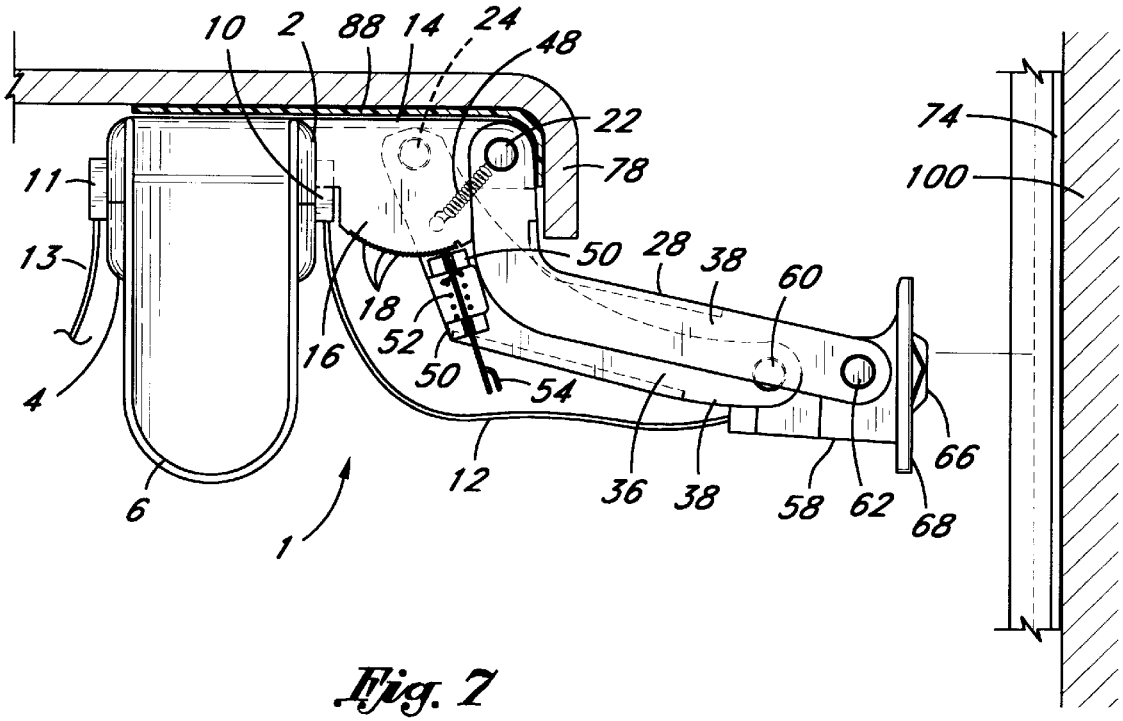
FIGS. 6 and 7 show the self-adjusting shelf mounted interconnect between rotated from an extended position to a retracted position in response to a pushing force generated when the bus connector of the interconnect is coupled to the vertical data bus to assure a reliable connection therebetween.

The vertical data bus 74 includes a plastic (e.g. PVC) mounting base 80 that is also approximately six feet long and two inches wide. As is best shown in FIGS. 5 and 6, the vertical data bus 74 runs along the back plane 100 of the gondola. A set of (e.g. six) electrical conductor strips 82 (best shown in FIG. 4) are held in spaced, parallel alignment with one another by the mounting base 80. Projecting from the center of mounting base 80 midway between the set of conductor strips 82 is an alignment port 84. The outermost ends of the mounting base 80 include screw pockets 86 to receive screws (not shown) should it be desirable to locate such screws through the screwholes 70 of mounting tabs 68 in order to removably attach the bus connector 58 of shelf mounted interconnect 1 to the vertical data bus 74 with the spring-loaded bus contacts 64 of bus connector 58 being held in electrical contact with respective conductor strips 82 of data bus 74. Moreover, the alignment tab 66 of bus connector 58 is received within the alignment port 84 of vertical data bus 74 to reliably and automatically position the bus contacts 64 so as to lie in electrical contact with the conductor strips 82 without additional manual intervention.

Referring specifically to FIG. 1, it is preferable to locate a shelf mounted interconnect 1 at the underside of shelf 78 in order to keep the interconnect out of site so as to avoid possible damage thereto and enhance the aesthetics of the gondola and shelf assembly. The foregoing may be accomplished by means of a layer of double thick foam adhesive (designated 88 and best shown in FIGS. 6 and 7) applied across the top of the upper housing 2 of interconnect 1. The ribbon cable 13 will correspondingly run below the shelf 78 from the circuit board connector 11 at the front of interface 1 to another circuit board connector (not shown ) that is electrically connected to the horizontal data bus 75 at the front of the shelf 78.

Any number of electronic shelf tags with digital displays (represented generally by the reference numeral 90), such as that described in co-pending U.S. patent application Ser. No. 08-565,733, can be clipped onto the front of shelf 78 to lie in electrical contact with horizontal data bus 75. Depending upon the respective positions of the electronic shelf tags 90 along bus 75, information may be selectively displayed to consumers regarding the goods that are stacked upon the shelf 78.

In this regard, the vertical data bus 74 at the shelf gondola is connected (by hard wires or other transmission means) to a remote central computer into which data is loaded concerning the goods on shelf 78. Power, price, and other information is transmitted between the remote computer and a particular shelf tag 90 via a data path consisting of vertical data bus 74, the contacts 64 of bus connector 58, ribbon cable 12 (best shown in FIG. 5), printed circuit board 92 (also best shown in FIG. 5), ribbon cable 12 and horizontal data bus 75 so as to actuate the tag 90 and control the information being displayed to consumers.

What is more, and referring briefly to FIG. 5, the aforementioned data path is illustrated including printed circuit hoard 92 and the ribbon cables 12 and 13 that link the remote computer to the electronic shelf tag 90 that is clipped to the front of shelf 78. As shown, ribbon cable 12 extends between circuit board connector 10 which engages an edge of the circuit board 92 at the rear of shelf mounted interconnect 1 and the bus connector 58 that is to be removably attached to the vertical data bus 74 of the gondola of FIG. 1. Ribbon cable 13 extends between circuit board connector 11 which engages another edge of the circuit board 92 at the front of shelf mounted interconnect 1 and a bus connector (not shown) that is to be attached to the horizontal data bus 74 at the front of the shelf 78.

The printed circuit board 92 which is surrounded by the upper and lower housings 2 and 4 of shelf mounted interconnect 1 includes the circuitry necessary to route information via the aforementioned data path from the remote computer to a particular electronic shelf tag 90 at the front of shelf 78 that is to display information to consumers about the goods on the shelf 78. One of the housings (e.g. the upper housing 2) includes pairs of flexible mounting tabs 94 and mounting posts 96 that are received through a corresponding number of alignment openings (not shown) in the circuit board 92 to automatically position and retain the circuit board 92 between the upper and lower housings 2 and 4. Latch access holes 98 are formed through circuit board 92 so that a pointed tool can be inserted therein to engage and detach the circuit board connectors 10 and 11 from opposite edges of the circuit board. Molded into the upper housing 2 is a diamond-shaped web 99 to better support circuit board 92 and provide a clearance for receipt of the electronic components that are carried on the circuit board.

Figure 7:
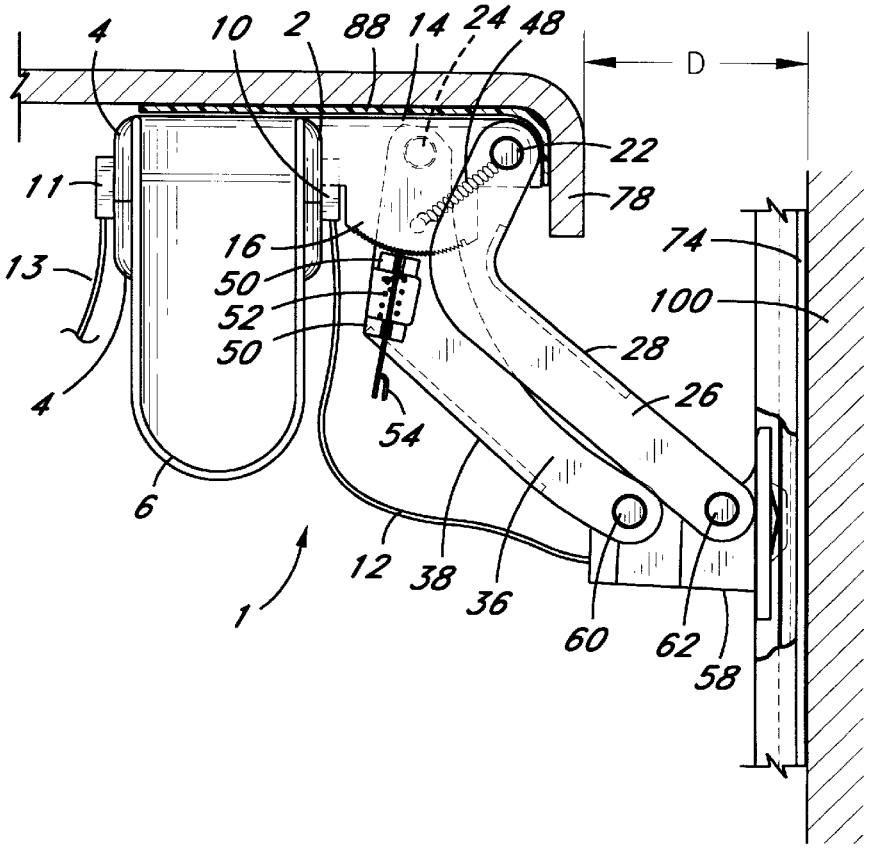

Turning now to FIGS. 6 and 7 of the drawings, the adjustable nature of the self-adjusting shelf mounted interconnect 1 is described for automatically mating the spring-loaded contacts 64 of bus connector 58 to the conductor strips 82 of vertical data bus 74. A gondola having the aforementioned pair of mounting rails 76 and the back plane 100 extending therebetween is installed in a retail (e.g. grocery) store with the vertical data bus 74 running alone back plane 100. However, the distance (designated D in FIG. 7) between the shelf 78, underneath which the interconnect 1 is mounted, and the back plane 100 can vary within a single store or from store-to-store. As an important detail of this invention, the length of the shelf mounted interconnect 1 is automatically adjustable between the extended position of FIG. 6 and the retracted position of FIG. 7 so as to compensate for the different distances D when the shelf 78 is detachably connected to the mounting rails 76 of the gondola.

That is to say, as the shelf 78 is detachably connected to the gondola and the bus connector 58 of self-adjusting interconnect 1 is correspondingly moved in its normally-biased extended position of FIG. 6 into engagement with the vertical bus 74 against the backplane 100, a pushing force will be applied to the bus connector 58 to move bus connector 58 towards the retracted position of FIG. 7. Accordingly, the side walls 28 and 38 of idler arm 26 and follower arm 36 will rotate in a clockwise direction around pivot pins 22 and 24, whereby coil springs 48 are stressed to store energy. By virtue of the fact that both ends the idler arm 26 and follower arm 36 are pivotally connected between pivot pins 22, 24 and 60, 62, the spring-loaded contacts (designated 64 in FIG. 3) of bus connector 58 will remain oriented in constant facing alignment with respective conductor strips (designated 82 in FIG. 3) of the vertical data bus 74 regardless of the rotation of bus connector 58 with the idler and follower arms 26 and 36. Thus, a reliable and immediate mating of contacts 64 to conductor strips 82 is automatically achieved in order to complete the data path between the electronic shelf tag (designated 90 in FIG. 1 ) to the remote computer.

Once the shelf 78 is attached to the gondola and the shelf mounted interconnect 1 is properly connected to the vertical data bus 74 along back plane 100 thereof, the pawls 54 are pushed through the guide channels 50 of respective pawl guides and into engagement with adjacent teeth 18 running along the side walls 16 of the hood 14 so as to maintain the coil springs in the stressed condition and prevent the bus connector 58 from being retracted (i.e. rotated) any further in the clockwise direction which could undesirably break the electrical connection between contacts 64 and conductor strips 82. Of course, the pawls 54 will be removed from the guide channels 50 in the event the bus connector 58 is detached from the vertical data bus 74 to permit the shelf 78 to be correspondingly detached from its gondola, whereby the energy stored in compression springs 48 will be released to cause the self-adjusting interconnect 1 to automatically move (i.e. rotate) in the clockwise direction back to its original extended position shown in FIG. 6.

In the preferred embodiment of the invention, the self-adjusting shelf mounted interconnect described herein has particular application in an electronic price tag system such as that described in the aforementioned U.S. patent application Ser. No. 08-565,733 for use in a retail store where a remote central computer communicates with a plurality of electronic price tag display modules along the front of a shelf via a slave controller mounted underneath the shelf to selectively access one of the display modules to receive and display the information transmitted by the computer. However, it is to be understood that this invention is not limited to the aforementioned price tag system but may also be used as a mechanical interconnect to enable information supplied from a computer to a first data bus to be transmitted via a data path to a second data bus and to a plurality of electronic storage or display units that are coupled to the second data bus.

We claim:

1. In combination:

first and second electrical buses carrying electrical signals; and a bus interconnect for electrically connecting said first and second electrical buses to one another so that said electrical signals can be transmitted therebetween, said bus interconnect including:

a bus connector having a series of electrical contacts to be electrically connected to said first electrical bus, a housing, first and second signal paths for transmitting said electrical signals between said first and second electrical buses, said first signal path connected between the electrical contacts of said bus connector and said housing and said second signal path connected between said housing and said second electrical bus, said housing having electrical circuitry for controlling said electrical signals transmitted between said first and second electrical buses via said first and second signal paths, and at least a first arm having first and second ends, said first end pivotally connected to said housing and said second end connected to said bus connector, whereby said arm is rotatable relative to said housing in response to a pushing force generated when said bus connector is electrically connected to said first electrical bus so that the position of the electrical contacts of said bus connector is adjustable relative to the location of said first electrical bus.

2. The combination recited in claim 1, wherein the second end of said first arm is pivotally connected to said bus connector so that said bus connector is rotatable relative to said first arm.

3. The combination recited in claim 1, said bus interconnect further comprising a second arm having first and second ends, the first ends of each of said first and second arms being pivotally connected to said housing and the second ends of each of said first and second arms being pivotally connected to said bus connector so that said first and second arms are rotatable relative to said housing and said bus connector is rotatable relative to said first and second arms.

4. The combination recited in claim 1, wherein said first electrical bus has a series of electrical contacts, the series of electrical contacts of said bus connector being rotated with said bus connector and moved into mating engagement with respective ones of the series of electrical contact, of said first electrical bus.

5. The combination recited in claim 1, wherein each of said first and second signal paths is a ribbon cable.

6. The combination recited in claim 1, wherein said electrical circuitry is enclosed by said housing.

7. The combination recited in claim 6, wherein said electrical circuitry is mounted on a printed circuit board and said printed circuit board is located within said housing.

8. The combination recited in claim 7, said bus interconnect further including a first circuit board connector extending through said housing and attached to said printed circuit board for electrically connecting said first signal path to said electrical circuitry mounted on said printed circuit board, and a second circuit board connector extending through said housing and attached to said printed circuit board for electrically connecting said second signal path to said electrical circuitry mounted on said printed circuit board.

9. The combination recited in claim 1, wherein said housing has a surface with a series of teeth running therealong, said bus interconnect further including a stop that is adapted to be coupled to said series of teeth to prevent the further rotation of said first arm relative to said housing.

10. The combination recited in claim 9, wherein said stop is a pawl carried by said first arm and slidable into detachable engagement with said series of teeth to prevent the further rotation of said first arm relative to said housing.

11. The combination recited in claim 10, further comprising a guide located on said first arm for slidably receiving said pawl therethrough.

12. In combination recited in claim 1, further comprising a computer connected to said first electrical bus to provide data signals to said second electrical bus when said bus connector is electrically connected to said first electrical bus.

13. The combination recited in claim 12, further comprising electronic display means connected to said second electrical bus to receive and display data depending upon the data signals provided by said computer, said computer communicating with said electronic display means via a data conduction path including said first electrical bus, the electrical contacts of said bus connector, said first signal path, the electrical circuitry of said housing, said second signal path, and said second electrical bus.

14. The combination recited in claim 13, further comprising a shelf upon which goods are placed for sale to the public, said shelf having a top, a bottom, and front and back ends, said second electrical bus running along the front of said shelf and said electronic display means electrically connected to said second electrical bus at the front of said shelf.

15. The combination recited in claim 14, wherein said housing is affixed to the bottom of said shelf, and said second signal path runs between said housing and said second electrical along the bottom of said shelf.

16. In combination:

a shelf upon which goods are placed;

an electronic display attached to said shelf to display information concerning the goods placed thereon;

first and second electrical buses, said electronic display electrically connected to said second electrical bus and said first electrical bus receiving information signals to be supplied to said electronic display concerning the goods placed upon said shelf; and a bus interconnect to electrically connect said first and second electrical buses to one another so that the information signals received by said first electrical bus are transmitted to said electronic display via said second electrical bus, said bus interconnect comprising:

a bus connector having electrical contacts to be electrically connected to said first electrical bus, an information signal path connected between the electrical contacts of said bus connector and said second electrical bus to transmit said information signals therebetween; and a housing attached to said shelf, said bus connector being pivotally interconnected with said housing so that the position of said bus connector is adjustable relative to said housing to enable the electrical contacts of said bus connector to be rotated into mating engagement with said first electrical bus in order to connect said information signal path to said first electrical bus.

* * * * *